United States Patent [19]

Harada et al.

[11] Patent Number: 4,758,498

[45] Date of Patent: Jul. 19, 1988

[54] PROCESSING COMPOSITION FOR USE IN COLOR DIFFUSION TRANSFER PHOTOGRAPHY CONTAINING A DYE IMAGE STABILIZER

[75] Inventors: Toru Harada; Shigeru Nakamura; Hiroshi Tanabe, all of Kanagawa, Japan

[73] Assignee: Fuji Photo Film Co., Ltd., Kanagawa, Japan

[21] Appl. No.: 918,223

[22] Filed: Oct. 14, 1986

[30] Foreign Application Priority Data

Oct. 15, 1985 [JP] Japan ..... 60-229542

[51] Int. Cl.[4] ..... G03C 5/54; G03C 5/24

[52] U.S. Cl. ..... 430/216; 430/214; 430/219; 430/372; 430/449; 430/467; 430/489; 430/490; 430/551

[58] Field of Search ..... 430/208, 216, 219, 551, 430/449, 467, 489, 490, 491, 214, 372, 611, 621; 864/80, 82, 84, 91, 98; 548/123, 209, 213; 562/430

[56] References Cited

U.S. PATENT DOCUMENTS 3,546,180 12/1970 Caldwell et al. ..... 562/430

4,039,520 8/1977 Habu et al. ..... 430/621

OTHER PUBLICATIONS

Research Disclosure 15162, Photographic Processes and Products, Nov. 1976, p. 83.

*Primary Examiner*—Roland E. Martin
*Assistant Examiner*—Patrick A. Doody
*Attorney, Agent, or Firm*—Sughrue, Mion, Zinn, Macpeak & Seas

[57] ABSTRACT

A processing composition for use in color diffusion transfer photograph is disclosed, comprising a compound represented formula (I):

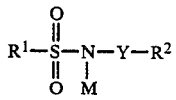

(I)

wherein $R^1$ and $R^2$ each represents an unsubstituted or substituted alkyl group, an unsubstituted or substituted aryl group, or $R^1$ and $R^2$ together form a ring; M represents a hydrogen atom, an alkali metal, an alkaline earth metal, or ammonium; and Y represents a sulfonyl or carbonyl group.

14 Claims, No Drawings

PROCESSING COMPOSITION FOR USE IN COLOR DIFFUSION TRANSFER PHOTOGRAPHY CONTAINING A DYE IMAGE STABILIZER

FIELD OF THE INVENTION

The present invention relates to a color diffusion transfer photographic element and, more particularly, to a processing composition for use in color diffusion transfer photography.

In a color diffusion transfer photographic element, a dye formed in an imagewise pattern is fixed in a dye mordanting layer to produce a dye image. During prolonged storage, the dye image tends to fade and/or the white background tends to become discolored, so as to deteriorate the quality of the image. In order to improve the keeping quality of the image, various techniques have heretofore been proposed.

For example, Japanese Patent Application (OPI) Nos. 105642/84 and 118834/85 (the term "OPI" as used hereinafter means an unexamined published Japanese patent application) describe dye mordants that increase the light-fastness of transferred dyes; U.S. Pat. Nos. 4,533,626 and 4,556,632 describe dyes having enhanced light-fastness.

U.S. Pat. No. 4,367,272 proposes a technique capable of providing improved light-fastness by incorporating a reducing material in a dye image-receiving unit; Japanese Patent Application (OPI) No. 142327/76 and U.S. Pat. No. 4,511,643 describe techniques intended to prevent the staining of the white background.

However, even these methods are not completely satisfactory in their effectiveness in rendering the dye image highly lightfast and providing adequate protection against the staining of the white background, and techniques capable of providing further improvements have been strongly desired.

SUMMARY OF THE INVENTION

One object, therefore, of the present invention is to provide a color diffusion transfer photographic element that is capable of producing an image having improved keeping quality.

Another object of the present invention is to provide a color diffusion transfer photographic element that is capable of effective prevention of the fading of an image dye and the staining of the white background.

These objects have been attained by incorporating in a processing composition for use in color diffusion transfer photography a compound of formula (I)

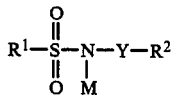

(I)

wherein $R^1$ and $R^2$ (which may be the same or different) each represents an unsubstituted or substituted alkyl group, an unsubstituted or substituted aryl group, or $R^1$ and $R^2$ together form a ring; M represents a hydrogen atom, an alkali metal, an alkaline earth metal, or ammonium; and Y represents a sulfonyl or carbonyl group.

DETAILED DESCRIPTION OF THE INVENTION

Specific examples of the compound of formula (I) are shown below. The substituted alkyl group represented by $R^1$ or $R^2$ can have a substituent such as a hydroxyl group, a halogen atom (e.g., a chlorine atom), an alkoxy group (e.g., a methoxy group, an ethoxy group), a carboxyl group, or a phenyl group. The substituted aryl group represented by $R^1$ or $R^2$ can have a substituent such as an alkyl group (e.g., a methyl group, an ethyl group), an alkoxy group (e.g., a methoxy group, an ethoxy group), an amino group, a substituted amino group (an illustrative substituents is an alkylsulfonyl group), a nitro group, a halogen atom (e.g., chlorine) or a carboxyl group.

Illustrative compounds (I):

1.

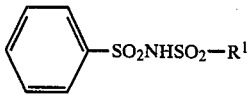

wherein $R^1$ = 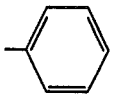

2.

Same as Compound 1 except that $R^1$ = 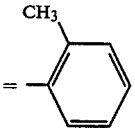

3.

Same as Compound 1 except that $R^1$ = 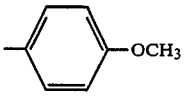

4.

Same as Compound 1 except that $R^1$ = 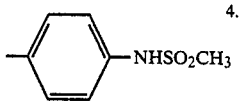

5.

Same as Compound 1 except that $R^1$ = 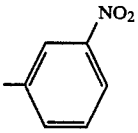

6.

Same as Compound 1 except that $R^1$ = 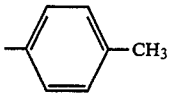

7. Same as Compound 1 except that $R^1 = CH_3$

8. Same as Compound 1 except that $R^1 = C_2H_5$

9. Same as Compound 1 except that $R^1 = C_4H_9(n)$

10.

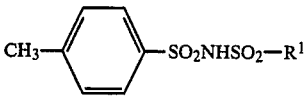

wherein $R^1$ = 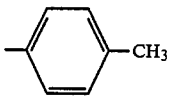

11.

Same as Compound 10 except that $R^1$ = 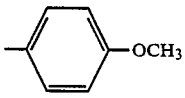

-continued

12. Same as Compound 10 except that $R^1$ = 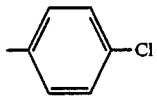

13. Same as Compound 10 except that $R^1$ = 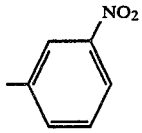

14. 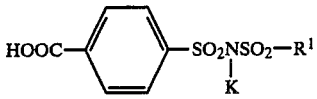

wherein $R^1$ = 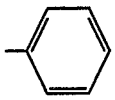

15. Same as Compound 14 except that $R^1$ = 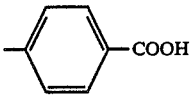

16. Same as Compound 14 except that $R^1$ = 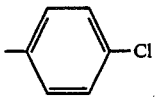

17. Same as Compound 14 except that $R^1$ = 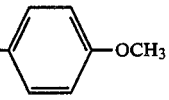

18. Same as Compound 14 except that $R^1$ = 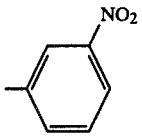

19. 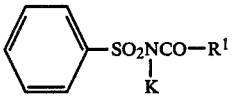

wherein $R^1$ = 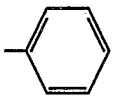

20. Same as Compound 19 except that $R^1$ = 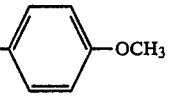

21. Same as Compound 19 except that $R^1$ = 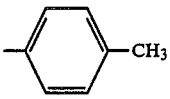

22. Same as Compound 19 except that $R^1$ = 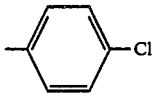

-continued

23. Same as Compound 19 except that $R^1$ = 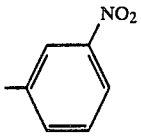

24. 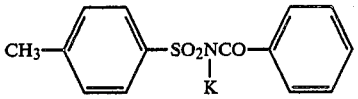

25. 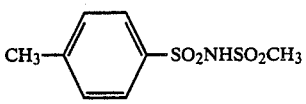

26. 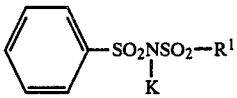

wherein $R^1$ = 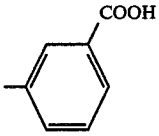

27. Same as Compound 26 except that $R^1$ = 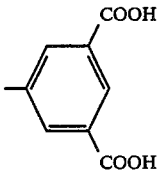

28. $CH_3SO_2NHSO_2CH_3$

29. 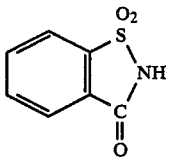

These compounds and the methods of their synthesis are described, e.g., in the *Journal of the American Chemical Society,* Vol. 62, pp. 1415–1416, 1940; ibid., Vol. 60, pp. 2222–2224, 1938; and U.S. Pat. No. 3,546,180. Compounds of formula (I) which are not shown in these references can be synthesized by methods that are analogous as those described therein. Syntheses of typical selected compounds of formula (I) are shown below.

SYNTHESIS 1

Synthesis of Compound 6

49 g of p-toluenesulfonyl chloride was added to a mixture of 31.4 g of benzenesulfonamide and 170 ml of water. 70 ml of a 50% solution of sodium hydroxide was added dropwise thereto while maintaining the temperature at 50° C. or less and the pH at 12 or less. After the dropwise addition, the mixture was stirred at 40° C. for 1 hour. Then, 18 ml of concentrated hydrochloric acid was added to the mixture and the precipitating crystal was collected by filtration. The resulting crystals were recrystallized from a mixed solvent of methyl alcohol and benzene (a mixing ratio: 1/10 (by volume)). Yield: 43 g; m.p.: 167°–169° C.

SYNTHESIS 2

Synthesis of Compound 7

43 ml of methanesulfonyl chloride and 140 ml of a 50% solution of sodium hydroxide was simultaneously added dropwise to a mixture of 69 g of benzenesulfonamide and 220 ml of water, with the temperature being held at 50° C. or less and the pH at 12 or less. After the dropwise addition, the mixture was stirred for 1 hour, and 36 ml of hydrochloric acid was added thereto. The precipitating crystal was collected by filtration and recrystallized from a mixed solvent of methyl alcohol and benzene (a mixing ratio: 1/10 (by volume)). Yield: 62 g; m.p.: 138°–139° C.

SYNTHESIS 31

Snythesis of Compound 14

62.2 g of compound 6 (as synthesized in Synthesis 1) was added to a mixture of 79 g of potassium permanganate and 400 ml of water. The mixture was stirred at 80° C. for 1 hour. After filtration, 15 ml of concentrated hydrochloric acid was added thereto. Then, the precipitating crystal was collected by filtration and recrystallized from a mixed solvent of methyl alcohol and water. Yield: 50 g; m.p.: ≧250° C.

SYNTHESIS 4

Synthesis of Compound 20

16.8 g of potassium tert-butoxide was added to a mixture of 23.6 g of benzenesulfonamide and 120 ml of tetrahydrofuran. The mixture was stirred for 20 minutes at room temperature. After concentrating under vacuum, 150 ml of acetonitrile and 23.6 g of p-methoxybenzoyl chloride was added and the mixture was stirred for 1 hour at room temperature. The resulting crystals were collected by filtration and recrystallized from water. Yield: 9.2 g; m.p.: ≧250° C.

Preferable compounds of formula (I) are those wherein M is a hydrogen atom or an alkali metal, and Y is a sulfonyl group.

The compound represented by formula (I) of the present invention is generally used in an amount which ranges from 0.1 to 10 mmol/$m^2$, and preferably from 0.5 to 5 mmol/$m^2$, in terms of the coating weight as attained after spreading the processing composition containing said compound.

A preferable photographic unit to which the processing composition of the present invention can be applied includes a support, a light-sensitive element, a dye imagereceiving element, and the alkaline processing composition of the present invention.

Belgian Patent No. 757,959 discloses an embodiment wherein a transparent cover sheet is placed in a face-to-face relationship on a light-sensitive sheet comprising a transparent support coated, in the order written, with an image-receiving layer, a light-reflective layer (e.g., a $TiO_2$ layer), a light-shielding layer (e.g., a carbon black layer), and a light-sensitive element consisting of light-sensitive silver halide emulsion layers combined with one or more of the dye image-providing compounds as described above. A rupturable container that accommodates an alkaline processing composition containing a light-shielding opacifying agent (e.g., carbon black) is disposed adjacent the topmost layer (protective layer) in the light-sensitive element and the transparent cover sheet. The film unit having this arrangement is exposed through the transparent cover sheet and, as the unit is ejected from the camera, the container is ruptured with a pressure-applying member so that the processing composition (containing the opacifying agent) is caused to spread in a uniform layer between the light-sensitive element and the cover sheet. This allows progressive development of the light-sensitive element in a light place while it is blocked from light exposure due to the sandwiched form.

It is recommended that a neutralizing mechanism be incorporated in the film unit of the embodiment shown above. A preferable method is to provide a neutralizing layer in the cover sheet, with a timing layer being optionally provided on the side where the processing solution is to be spread.

Other useful laminated integral structures in which the processing composition of the present invention can be employed are described in U.S. Pat. Nos. 3,415,644, 3,415,645, 3,415,646, 3,647,487 and 3,635,707, and German Patent Application (OLS) No. 2,426,980.

In still another preferable embodiment, a multi-layered dye image-receiving element having the sequence of a support, a neutralizing layer, a neutralizing speed control layer, and an image-receiving layer is placed in a face-to-face relationship on a light-sensitive element whereon one or more light-sensitive layers are coated successively on a support, and the alkaline processing solution of the present invention is allowed to spread between the two elements. In this case, the image-receiving element may be peeled off after image transfer. Alternatively, as shown in U.S. Pat. No. 3,415,645, a transparent support is used for the image-receiving layer and a reflective layer is provided between the image-receiving layer and the light-sensitive element, thereby permitting direct viewing of the image without stripping the image-receiving element.

Examples of supports that can be used with the cover sheet and other elements described above are described in *Research Disclosure,* RD No. 15162, page 85, right column, lines 34–67. For the neutralizing layer and the timing layer, reference can be made to *Research Disclosure,* RD No. 15162, page 85, right column, line 68 to page 86, left column, line 21 from the bottom.

For details regarding a monosheet type color diffusion transfer photographic film unit having the abovedescribed light-sensitive sheet and cover sheet, reference may be made to *Photographic Science and Engineering* (P.S.E.), Vol. 20, No. 4, pp. 155–160 (1976); *Kagaku no Ryoiki* (*Field of Chemistry*), Vol. 36, No. 9, pp. 617–622 (1982); and *Research Disclosure,* Vol. 151, RD No. 15162, November 1976, page 76, left column, lines 31–42. For mordants and other components used in the image-receiving layer, reference may be made to *Research Disclosure,* ibid., RD No. 15162, page 80, right column, line 15 from the bottom to page 82, right column, line 33 from the bottom. For the light-reflective layer and the materials used therein, reference may be made to *Research Disclosure,* ibid., RD No. 15162, page 82, left column, line 32 from the bottom to page 82, right column, line 5 from the bottom. For the light-shielding layer and the materials used therein, reference may be made to *Research Disclosure,* ibid., No. 15162, page 82, right column, line 4 to page 83, left column, line 21 from the bottom. For the dye image-providing compounds and emdobiments of their use, reference may be made to *Research Disclosure,* ibid., RD No. 15162, page 83, left column, line 2 from the bottom to right column, line 49. A particularly advantageous dye image-providing material is the redox dye releaser described in *Research Disclosure,* ibid., RD No. 15162, page 83, right column, line 4. The silver halide emulsion for use in the light-sensitive silver halide emulsion layer is preferably a direct positive image-providing internal-image emulsion of the type described in *Research Disclosure,* ibid., RD No. 15162, page 76, right column, line 24. The internal-image emulsion may contain a spectral sensitizer, an anit-foggant or any other useful additives as described in *Research Disclosure,* ibid., RD No. 15162. For the hydrophilic colloid binders and other components that may be used in the light-sensitive sheet, reference may be made to *Research Disclosure,* ibid., RD No. 15162, page 83, left column, lines 20 to 3 from the bottom.

In the present invention, gelatin is preferably used as a hydrophilic colloid in the light-sensitive sheet, and a film hardener may be employed for the purpose of hardening the gelatin.

The processing composition of the present invention for use in color diffusion transfer photography is a liquid composition that contains the processing components necessary for the development of silver halide emulsions and for the formation of a diffusion transfer color image of a dye image that remains after the released dye has separated. The solvent is predominantly made of water and may contain a hydrophilic solvent such as methanol or 2-methoxyethanol. The processing composition contains an alkali in an amount sufficient to maintain the necessary pH for causing the development of the emulsion layers and to neutralize the acids (such as hydrohalogenic acids illustrated by hydrobromic acid) that are produced during development and in various steps for dye image formation.

The silver halide developing agent contained in the processing composition of the present invention may be of any type of silver halide developing agent so long as it is capable of cross-oxidation with the dye-releasing redox compound. It suffices that this developing agent is activated by the time substantial development of silver halide is initiated by the alkaline processing composition, so that said agent may be incorporated in the light-sensitive element. Specific examples of the developing agent that may be employed are listed below: 3-pyrazolidinones such as 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxy)-3-pyrazolidinone, 4,4-bis(hydroxymethyl)-1-phenyl-3-pyrazolidinone, 4,4-bis(hydroxymethyl)-1-tolyl-3-pyrazolidinone, 4,4-bis(hydroxymethyl)-1-(4'-methoxy)-3-pyrazolidinone, 4,4-dimethyl-1-tolyl-3-pyrazolidinone, 1,5-diphenyl-3-pyrazolidinone, and 4-hydroxymethyl-4-methyl-1-(3'-methoxyphenyl)-3-pyrazolidinone; aminophenols such as p-aminophenol, p-methylaminophenol, p-dimethylaminophenol, p-dibutylaminophenol, p-piperidinophenol and 4-dimethylamino-2,6-dimethoxyphenol.

The advantage of the present invention will respect to its ability to prevent staining of the white background of the image during the passage of time after image formation is particularly pronounced when a 3-pyrazolidinone is used as the developing agent. Staining of the white background can also be prevented by the present invention when a 3-pyrazolidinone is used as an auxiliary developing agent.

The alkalinity providing material used in the alkaline processing composition of the present invention is chiefly an alkali metal hydroxide such as sodium hydroxide, potassium hydroxide, rubidium hydroxide, or cesium hydroxide. Other usable alkalinity providing materials are sodium carbonate and amines such as diethylamine. The alkaline processing composition preferably contains one or more of these alkalinity providing materials in such amounts that it attains a pH higher than 11.

The alkaline processing composition of the present invention preferably contains a viscosity-increasing compound, a typical example of which is an ether that is inert to alkaline solutions, such as an alkali metal salt of hydroxyethyl cellulose or carboxymethyl cellulose (e.g., sodium carboxymethyl cellulose). Such viscosity-increasing compound is advantageously contained at a concentration ranging from 1 to 10 wt % of the processing composition. A preferable viscosity that should be attained is within the range of from about 100 to 200,000 cps. Therefore, in addition to the viscosity-increasing compounds listed above, polysaccharide gums such as guar gum, and xanthans and algins of the types described in *Research Disclosure,* ibid., RD No. 15162, November 1976 may also be employed as viscosity-increasing compounds.

The alkaline processing composition of the present invention preferably contains an opacifying agent such as carbon black, titanium dioxide, or a light-absorbing dye such as an indicator dye. A preferable kind of indicator dye is one that remains transparent during exposure and becomes colored or turns opaque after it is brought into contact with the alkali from the processing composition.

The photographic unit for use with the present invention may contain a variety of compounds, the choice of which depends on the specific use of the unit, but preferably such additives are incorporated in the alkaline processing composition.

The photographic unit for use with the present invention may incorporate additives that are capable of increasing the density of the transfer image. Examples are aromatic alcohols of the types shown in U.S. Pat. No. 3,846,129, such as benzyl alcohol and p-xylene-$\alpha,\alpha'$-diol. Other examples are aliphatic or alicyclic glycols, and saturated aliphatic or alicyclic aminoalcohols, such as 1,4-cyclohexanedimethanol, 1,6-hexanediol, 3-amino-1-propanol, 2-amino-1-propanol, 5-amino-1-pentanol, 6-amino-1-hexanol, and 2-amino-2-methyl-1-propanol, as described in U.S. Pat. No. 4,030,920.

Still other compounds that may be used to provide increased Dmax are the colloidal silica and potassium iodide, as described in *Research Disclosure,* ibid., RD No. 15162, November 1976.

Salts of polyvalent metallic ions may also be added in order to improve the time-dependent stability of the processing solution.

In order to prevent pimple-like deformations from occurring after substantial completion of development, the photographic unit used with the present invention may contain alkali metal fluorides or oxalates or barium salts thereof of the types shown in U.S. Pat. No. 3,942,987.

The photographic unit for use with the present invention may also incorporate a competing developing agent of the type shown in *Research Disclosure,* ibid., RD No. 15162, November 1976, with a view to achieving tone control. Illustrative competing developing agents are hydroquinone, methyl hydroquinone, and t-butyl hydroquinone.

The photographic unit for use with the present invention may further contain compounds as described in U.S. Pat. No. 2,497,917 such as 5-methyl benzotriazole, 5,6-dichlorobenzotriazole, 6-nitrobenzimidazole, and histidine.

The alkaline processing composition of the present invention typically has a pigment such as carbon black or titanium dioxide dispersed uniformly therein. In this case, a dispersion aid or a surfactant may also be used as being selected from known compounds such as polyacrylic acid, naphthalenesulfonic acid, the polycondensation product of naphthalenesulfonic acid and formaldehyde, and alkali metal salts of compounds such as poly(styrenesulfonic acid).

The color diffusion transfer photographic processing composition of the present invention which contains a compound represented by formula (I), in particular, a disulfonamide compound, has the advantage of forming a dye image that has superior light-fastness and which experiences minimum staining of the white background during the passage of time. These advantages are particularly noticeable in an embodiment wherein a processing composition containing the compound of formula (I) and a 3-pyrazolidinone (e.g., 4-hydroxymethyl-4-methyl-1-phenyl-3-pyrazolidinone) is caused to be spread between an image-receiving sheet wherein a neutralizing layer, a neutralization speed control layer (timing layer) and an image-receiving layer are successively formed on a support and a light-sensitive sheet which has on another support light-sensitive silver halide emulsion layers combined with dye image-providing compounds.

The following examples are provided for the purpose of further illustrating the present invention but should in no sense be taken as limiting the invention.

EXAMPLE 1

A light-sensitive sheet was prepared by coating the following layers (1) to (11) successively on an opaque support.

(1) Layer containing a cyan DRR compound (dye releasing redox) (0.36 mmol/m$^2$) of the formula shown below, tricyclohexyl phosphate (0.09 g/m$^2$), 2,5-di(t-pentadecyl)hydroquinone (0.01 g/m$^2$) and gelatin (0.44 g/m$^2$):

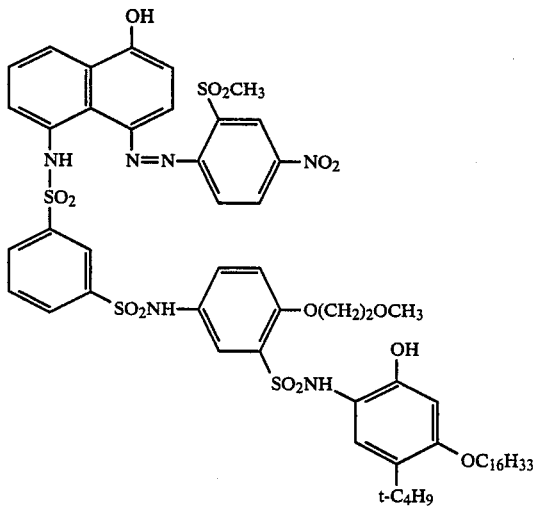

(2) Layer containing a red-sensitive, internal-image, direct reversal silver bromide emulsion (0.5 g/m$^2$ in terms of silver), gelatin (0.78 g/m$^2$), a nucleating agent (27 μg/m$^2$) of the formula shown below, and solium pentadecylhydroquinonesulfonate (0.06 g/m$^2$):

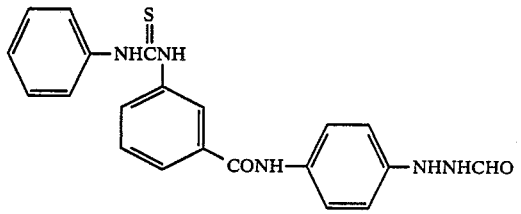

(3) Layer containing 2,5-di(tert-pentadecyl)hydroquinone (0.71 g/m$^2$), a copolymer (0.24 g/m$^2$) of vinylpyrrolidone and vinyl acetate (molar ratio, 7/3), and gelatin (0.4 g/m$^2$);

(4) Layer containing gelatin (0.3 g/m$^2$);

(5) Layer containing a magenta DRR compound (0.49 g/m$^2$) of the formula shown below, tricyclohexyl phosphate (0.08 g/m$^2$), 2,5-di(tert-pentadecyl)hydroquinone (0.01 g/m$^2$) and gelatin (0.5 g/m$^2$):

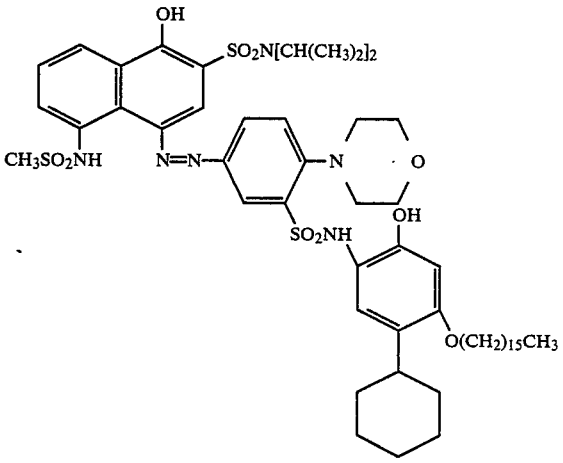

(6) Layer containing a green-sensitive, internal-image, direct reversal silver bromide emulsion (0.34 g/m$^2$ in terms of silver), gelatin (0.66 g/m$^2$), a nucleating agent (12.9 μg/m$^2$) of the same type as used in layer (2), and sodium pentadecylhydroquinonesulfonate (0.04 g/m$^2$);

(7) Layer containing 2,5-di(tert-pentadecyl)hydroquinone (0.71 g/m$^2$), a copolymer (0.24 g/m$^2$) of vinylpyrrolidone and vinyl acetate (molar ratio, 7/3), and gelatin (0.4 g/m$^2$);

(8) Layer containing gelatin (0.25 g/m$^2$);

(9) Layer containing a yellow DRR compound (0.48 g/m$^2$) of the formula shown below, tricyclohexyl phosphate (0.03 g/m$^2$), 2,5-di(tert-pentadecyl)hydroquinone (0.004 g/m$^2$) and gelatin (0.43 g/m$^2$):

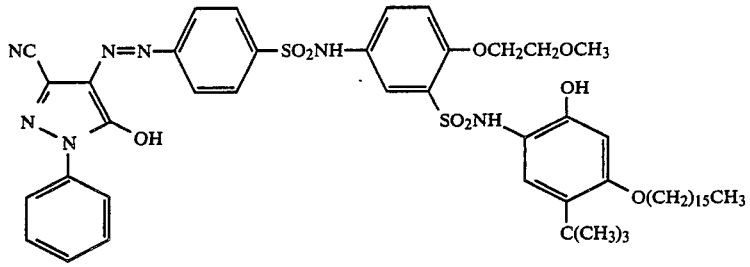

(10) Layer containing a blue-sensitive, internal-image, direct reversal silver bromide emulsion (0.84 g/m$^2$ in terms of silver), gelatin (0.9 g/m$^2$), a nucleating agent (29 μg/m$^2$) of the same type as used in layer (5), and sodium pentadecylhydroquinonesulfonate (0.05 g/m$^2$); and

(11) Layer containing gelatin (1.0 g/m$^2$).

In a separate step, a dye image-receiving sheet was prepared by successively coating the following layers (12) to (16) on the obverse side of a white support the reverse side of which had been coated successively with a carbon black layer and a titanium white layer.

(12) Layer containing a 80/20 (by weight) copolymer of acrylic acid and butyl acrylate (22 g/m$^2$) and 1,4-bis(2,3-epoxypropoxy)-butane (0.44 g/m$^2$);

(13) Layer containing acetyl cellulose (3.8 g/m$^2$) (100 g of acetyl cellulose would be hydrolyzed to generate 39.4 g of acetyl groups), a 60/40 (by weight) copolymer of styrene and maleic anhydride (Mw≃5×10$^4$) (0.2 g/m$^2$), and 5-(β-cyanoethylthio)-1-phenyltetrazole (0.115 g/m$^2$);

(14) Layer containing a 85/12/3 (by weight) copolymer latex of vinylidene chloride, methyl acrylate, and acrylic acid (2.5 g/m$^2$) and a polymethyl methacrylate latex (particle size=1–3 μm) (0.05 g/m$^2$);

(15) Layer containing a mordant (3.0 g/m$^2$) of the formula shown below, and gelatin (3.0 g/m$^2$):

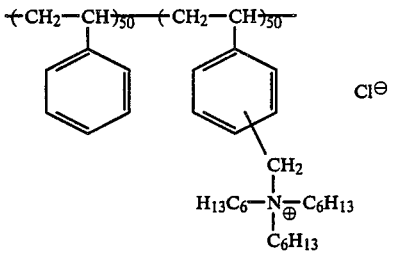

(16) Layer containing phthalated gelatin (1 g/m$^2$).

A processing solution having the following formulation was charged into a rupturable container in an amount of 0.8 g.

| Components | Amounts |
|---|---|
| Benzyl alcohol | 0.20 ml |
| 1-Phenyl-4-hydroxymethyl-4-methyl-3-pyrazolidinone | 0.3 g |
| Methyl hydroquinone | 0.012 g |
| 5-Methylbenzotriazole | 0.6 g |
| Sodium sulfite | 0.18 g |
| Hydroxymethyl cellulose | 4 g |
| Potassium hydroxide (28% aq. sol.) | 22.4 ml |
| $H_2O$ | 67 ml |

Based on the composition of processing solution A, processing solutions B to F were prepared by adding 6 mmol of compounds 7, 15, 25, 27, and 29 of the present invention, respectively.

After being exposed, the light-sensitive sheet was superposed on the dye image-receiving sheet and one of the processing solutions A to F was caused to spread in a layer 60 μm thick between the two sheets by means of a pressure-applying member. The thus obtained samples A to F each carrying a color transfer image were subjected to a light fading test for 2 weeks under a fluorescent lamp (17,000 lux). The decrease in the cyan density ($\Delta D^R$) of the area which had an initial cyan density of 1.0 was measured for each sample. The results are shown in Table 1.

TABLE 1

| Processing Solution | Compound of Formula (I) | Light Fading ($\Delta D^R$) |
|---|---|---|
| A (control) | — | .18 |
| B | 7 | .12 |
| C | 14 | .09 |
| D | 25 | .12 |
| E | 27 | .09 |
| F | 29 | .10 |

The data in Table 1 show that great improvement in the light-fastness of color transfer images could be achieved by using the compounds of the present invention.

EXAMPLE 2

Samples A to F prepared as in Example 1 were left for 6 months at room temperature and checked for any staining of the white background. Data of $\Delta D_{min}=D_{min}-Do_{min}$ ($Do_{min}$ is the density of $D_{min}$ area before standing; and D is the density of D area after standing) are set forth in Table 2.

TABLE 2

| Processing Solution | Compound (I) | $\Delta D^B_{min}$ | $\Delta D^G_{min}$ | $\Delta D^R_{min}$ |
|---|---|---|---|---|
| A (control) | — | 0.04 | 0.12 | 0.01 |
| B | 7 | 0.03 | 0.05 | .00 |
| C | 14 | 0.02 | 0.04 | .00 |
| D | 25 | 0.03 | 0.05 | .01 |
| E | 27 | 0.02 | 0.04 | .01 |
| F | 29 | 0.03 | 0.06 | .00 |

The above data shows that staining of the white background was appreciably reduced by using the compounds of the present invention.

While the invention has been described in detail and with reference to specific embodiments thereof, it will be apparent to one skilled in the art that various changes and modifications can be made therein without departing from the spirit and scope thereof.

What is claimed is:

1. An aqueous alkaline processing composition for use in development of a color diffusion transfer photographic element, said element comprising a substrate, a silver halide emulsion, a dye-image forming compound, an image-receiving layer, and said processing composition comprising a silver halide developing agent in an amount sufficient to develope said silver halide emulsion and an image stabilizing amount of a compound represented by formula (I)

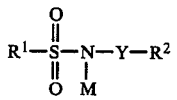

(I)

wherein $R^1$ and $R^2$ each represents an unsubstituted or substituted alkyl group, an unsubstituted or substituted aryl group, or $R^1$ and $R^2$ together form a ring; M represents a hydrogen atom, an alkali metal, an alkaline earth metal, or ammonium; and Y represents a sulfonyl or carbonyl group.

2. A processing composition as in claim 1, wherein M is a hydrogen atom or an alkali metal, and Y is a sulfonyl group.

3. A color diffusion transfer photographic material comprising a substrate, a silver halide emulsion, a dye-image forming compound, an image-receiving layer, and an aqueous alkaline processing composition wherein said aqueous alkaline processing composition comprises a compound represented by formula (I)

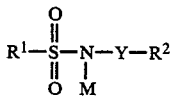

(I)

wherein $R^1$ and $R^2$ each represents an unsubstituted or substituted alkyl group, an unsubstituted or substituted aryl group, or $R^1$ and $R^2$ together form a ring; M represents a hydrogen atom, an alkali metal, an alkaline earth metal, or ammonium; and Y represents a sulfonyl or carbonyl group.

4. A photographic material as in claim 3, wherein M is a hydrogen atom or an alkali metal, and Y is a sulfonyl group.

5. A photographic material as in claim 3, wherein the compound represented by formula (I) is present in an amount such as that when spread over the area of the photographic material said compound represented by formula (I) is present in an amount of from 0.5 to 5 mmol/$m^2$.

6. A photographic material as in claim 4, wherein the compound represented by formula (I) is present in an amount such that when spread over the area of the photographic material said compound represented by formula (I) is present in an amount of from 0.1 to 10 mmol/$m^2$.

7. A photographic material as in claimed in claim 3, wherein Y represents a carbonyl group.

8. A photographic material is claimed in claim 3, wherein the aqueous alkali developer solution is contained in a pod.

9. A color diffusion transfer photographic material as claimed in claim 3, wherein said aqueous alkaline processing composition contains a silver halide developing agent capable of cross-oxidation with a dye-releasing redox compound.

10. A processing composition as claimed in claim 9, wherein said viscosity-increasing compound is selected from the group consisting of polysaccharide gums and algins.

11. An aqueous alkaline processing composition for use in development of a color diffusion transfer photographic element, said element comprising a substrate, a silver halide emulsion, a dye-image forming compound, an image-receiving layer, and said processing composition comprising a compound represented by formula (I)

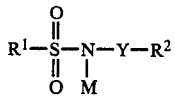

(I)

wherein $R^1$ and $R^2$ each represents an unsubstituted or substituted alkyl group, an unsubstituted or substituted aryl group, or $R^1$ and $R^2$ together form a ring; M represents a hydrogen atom, an alkali metal, an alkaline earth metal, or ammonium; and Y represents a carbonyl group.

12. An aqueous alkaline processing composition for use in development of a color diffusion transfer photographic element, said element comprising a substrate, a silver halide emulsion, a dye-image forming compound, an image-receiving layer, and said processing composition comprising a compound represented by formula (I)

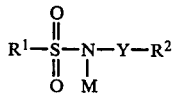

(I)

wherein $R^1$ and $R^2$ each represents an unsubstituted or substituted alkyl group, an unsubstituted or substituted aryl group, or $R^1$ and $R^2$ together form a ring; M represents a hydrogen atom, an alkali metal, an alkaline earth metal, or ammonium; Y represents a sulfonyl or carbonyl group; and wherein said processing composition further contains a viscosity-increasing compound in a concentration ranging from 1 to 10 weight percent of the processing composition.

13. An aqueous alkaline processing composition for use in development of a color diffusion transfer photographic element, said element comprising a substrate, a silver halide emulsion, a dye-image forming compound, an image-receiving layer, and said processing composition comprising a compound represented by formula (I)

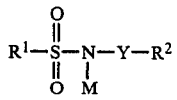

(I)

wherein $R^1$ and $R^2$ each represents an unsubstituted or substituted alkyl group, an unsubstituted or substituted aryl group, or $R^1$ and $R^2$ together form a ring; M represents a hydrogen atom, an alkali metal, an alkaline earth metal, or ammonium; Y represents a sulfonyl or carbonyl group; and wherein said processing composition further contains an opacifying agent selected from the group consisting of carbon black, titanium dioxide, or a light-absorbing dye.

14. An aqueous alkaline processing composition for use in development of a color diffusion transfer photographic element, said element comprising a substrate, a silver halide emulsion, a dye-image forming compound, an image-receiving layer, wherein said processing composition comprises a silver halide developing agent in an amount effective to cause development of said silver halide emulsion and a compound represented by formula (I)

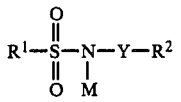

(I)

wherein $R^1$ and $R^2$ each represents an unsubstituted or substituted alkyl group, an unsubstituted or substituted aryl group, or $R^1$ and $R^2$ together form a ring; M represents a hydrogen atom, an alkali metal, an alkaline earth metal, or ammonium; Y represents a sulfonyl or carbonyl group; and the compound represented by formula (I) is present in an amount of from 0.1 to 10 mmole/$m^2$.

* * * * *